US009438974B2

(12) United States Patent
Marcum et al.

(10) Patent No.: US 9,438,974 B2
(45) Date of Patent: Sep. 6, 2016

(54) SPEAKER ASSEMBLY WITH CLAMPING SUBASSEMBLIES

(71) Applicant: Audio Components International, Inc., Rolling Hills Estates, CA (US)

(72) Inventors: Bryan Thomas Marcum, Georgetown, KY (US); Joshua William Stitzer, Lexington, KY (US)

(73) Assignee: Audio Components International, Inc., Rolling Hills Estates, CA (US)

( * ) Notice: Subject to any disclaimer, the term of this patent is extended or adjusted under 35 U.S.C. 154(b) by 9 days.

(21) Appl. No.: 14/600,692

(22) Filed: Jan. 20, 2015

(65) Prior Publication Data

US 2015/0271578 A1 Sep. 24, 2015

Related U.S. Application Data

(60) Provisional application No. 61/968,510, filed on Mar. 21, 2014.

(51) Int. Cl.
*H04R 1/02* (2006.01)
*H04R 1/26* (2006.01)

(52) U.S. Cl.
CPC . *H04R 1/02* (2013.01); *H04R 1/26* (2013.01); *H04R 2201/029* (2013.01)

(58) Field of Classification Search
USPC ..... 381/332, 386, 334; 181/199; 239/289
See application file for complete search history.

(56) References Cited

U.S. PATENT DOCUMENTS 6,588,543 B1 * 7/2003 Tchilinguirian ..... F21V 21/04 181/150
7,003,129 B2 2/2006 Hecht
7,172,160 B2 2/2007 Piel et al.
7,298,863 B2 11/2007 Kirihara et al.
7,587,059 B2 9/2009 Wright
7,631,850 B2 12/2009 Lee et al.
7,731,130 B2 6/2010 Decanio et al.

(Continued)

OTHER PUBLICATIONS

ISA/US, International Search Report issued in corresponding international application No. PCT/US2015/021774, mailed Jun. 25, 2015.

(Continued)

*Primary Examiner* — Fan Tsang
*Assistant Examiner* — Angelica M McKinney
(74) *Attorney, Agent, or Firm* — Stites & Harbison, PLLC; David W. Nagle, Jr.; James R. Hayne

(57) ABSTRACT

A speaker assembly has a speaker housing and one or more clamping subassemblies, with each subassembly including a drive dog, a clamping dog with a dogleg, a compression spring, and a dog screw, and with each subassembly capable of transitioning between four positions. In a parked position, the entire clamping subassembly is housed in the speaker housing with the compression spring in a compressed state between drive dog and the clamping dog. By rotating the dog screw, the clamping subassembly is transitioned to a ready-to-release position where the dogleg of the clamping dog extends out of the speaker housing. By pushing the dog screw, the clamping subassembly is transitioned to a released position, where the compression spring forces the clamping dog away from the drive dog. By further rotating the dog screw, the clamping subassembly is transitioned to a clamped position, where the compression spring returned to the compressed state.

17 Claims, 13 Drawing Sheets

(56) References Cited

U.S. PATENT DOCUMENTS

| | | | | |
|---|---|---|---|---|
| 7,780,135 | B2 | 8/2010 | Nelson et al. | |
| 8,023,664 | B2 | 9/2011 | Yang | |
| 8,148,634 | B1 | 4/2012 | Gretz | |
| 8,256,728 | B2 | 9/2012 | Wright | |
| 8,490,938 | B2 | 7/2013 | Peng | |
| 8,528,264 | B1 | 9/2013 | Thut et al. | |
| 2008/0192490 | A1 | 8/2008 | Brown | |
| 2008/0199037 | A1 | 8/2008 | Xu et al. | |
| 2010/0040254 | A1* | 2/2010 | Wright | H04R 1/02 381/395 |
| 2010/0252703 | A1* | 10/2010 | Wright | H04R 1/025 248/221.11 |
| 2011/0311085 | A1* | 12/2011 | Stewart, Jr. | H04R 1/025 381/332 |
| 2012/0002835 | A1* | 1/2012 | Stewart, Jr. | H04R 1/025 381/386 |
| 2012/0119042 | A1 | 5/2012 | Peng | |
| 2013/0251181 | A1* | 9/2013 | Stewart, Jr. | H04R 1/02 381/332 |
| 2014/0305734 | A1* | 10/2014 | Ivey | H04R 1/025 181/150 |

OTHER PUBLICATIONS

Origin Acoustics, (Composer LCR38), Product Web Page available at http://www.originacoustics.com/#product/2861.

* cited by examiner

SPEAKER ASSEMBLY WITH CLAMPING SUBASSEMBLIES

CROSS-REFERENCE TO RELATED APPLICATIONS

The present application claims priority to U.S. Provisional Patent Application Ser. No. 61/968,510 filed on Mar. 21, 2014, the entire disclosure of which is incorporated herein by reference.

BACKGROUND OF THE INVENTION

The present invention generally relates to the field of in-wall and in-ceiling loudspeakers (or speakers). More specifically, it relates to the means of mounting such speakers (or similar products) within a wall or ceiling using one or more clamping subassemblies, which substantially prevent potential damage to the speakers during installation and improve the "ease-of-use" during installation.

Traditionally, speakers are mounted within a wall or ceiling using one or more simple dogleg-shaped clamps (or clamping dogs) and associated screws. The screws are driven using either a manual screwdriver or powered driver for each clamping dog associated with the speaker. These traditional approaches require numerous steps, particularly for in-ceiling installations while the installer is on a ladder. During installation, it is often necessary to either use a manual screwdriver to disengage all clamping dogs from their respective "parked" positions in order to provide a means of retention in the ceiling (but still not securely clamped), and then finishing the installation using a powered driver. Or, if one chooses, the speaker may be installed using a powered driver while holding the speaker in place with a free hand and individually driving each clamping dog until all clamping subassemblies are secure. This is a tedious and time-consuming process which can result in extra installation steps, increased installation costs, and/or potential damage to the speaker if the screwdriver or powered driver slips due to the fact that one hand must be used to secure the speaker and the other must be used to operate the driver.

It is thus desirable to create a dogleg-style clamping subassembly which may be operated using a simple, lightweight tool and requires minimum force and range of motion to secure the speaker (or similar product) in the wall or ceiling. Limiting force requirements and motion is key to substantially improving the ease-of-use. With respect to the installation tool, it may either be pre-attached to the speaker assembly or could also be a hand tool common to the industry.

Furthermore, in traditional dogleg clamping systems, during in-ceiling installations, the screw which is used to secure each clamping dog may "eject" out of the front of the speaker due to gravity and/or weight of the clamping system. This increases the odds of a screwdriver or powered driver bit slipping out of the screw head and striking the speaker, which can cause damage. Also, in traditional dogleg clamping systems, the speaker is not safely secured in the wall or ceiling until the final installation step using a powered driver. Finally, if springs are used in a clamping system, if the springs are not compressed, there can be a rattling sound during use.

SUMMARY OF THE INVENTION

The present invention is a speaker assembly, including one or more clamping subassemblies, which substantially prevents potential damage to the speaker during installation and improves the "ease-of-use" during installation.

One exemplary speaker assembly includes a speaker housing with a cylindrical outer wall and a circular front lip (or flange). The speaker assembly further includes one or more clamping subassemblies housed in the speaker housing. In particular, for each clamping subassembly, the speaker housing defines a substantially cylindrical cavity referred to herein as a "dog tower" and an adjacent cavity referred to herein as a "clamping dog recess."

Each clamping subassembly includes a drive dog, a clamping dog with a dogleg, a compression spring that extends and is compressed between the drive dog and the clamping dog, and a dog screw that extends through the drive dog as well as through the clamping dog. The clamping subassemblies are each capable of transitioning between four different positions or configurations: a parked position; a ready-to-release position; a released position; and a clamped position.

In the parked position, the entire clamping subassembly is contained in the speaker housing. Specifically, the dogleg of the clamping dog is housed in the clamping dog recess defined by the speaker housing, and the rest of the clamping subassembly is housed in the dog tower defined by the speaker housing. In this way, in the parked position, no portion of the clamping subassembly extends beyond the boundary defined by the outer wall of the speaker housing. Furthermore, in the parked position, the drive dog is engaged with the clamping dog with the compression spring in a compressed state between the drive dog and the clamping dog.

In the ready-to-release position, the clamping subassembly is only partially housed within the speaker housing. Specifically, the dogleg of the clamping dog has rotated around a longitudinal axis defined by the dog screw, and the dogleg of the clamping dog now extends out of the outer wall of the speaker housing, with a lateral surface of the dogleg in contact with the speaker housing. The rest of the clamping subassembly is still housed in the dog tower with the drive dog, the clamping dog, and the compression spring in the same position relative to each other as in the parked position. In other words, the drive dog is engaged with the clamping dog, with the compression spring in a compressed state between the drive dog and the clamping dog. However, in the ready-to-release position, the entire clamping subassembly has moved upward a predetermined distance in relation to the speaker housing as compared to when the clamping subassembly was in the parked position, such that the dog screw extends out from the speaker housing.

In the released position, the dogleg still extends out of the outer wall of the speaker housing, with the lateral surface of the dogleg in contact with the speaker housing, and the rest of the clamping subassembly is still housed in the dog tower, similar to the ready-to-release position. However, in the released position, the drive dog is rotated relative to the speaker housing and the clamping dog as compared to the ready-to-release position. The rotation of the drive dog causes the drive dog to disengage the clamping dog, such that the compression spring is released. Accordingly, under the biasing force of the compression spring, the clamping dog is now moved to the top of the dog tower, while the drive dog is at the bottom of the dog tower. The compression spring in now in an uncompressed state between the drive dog and the clamping dog. Furthermore, both the drive dog and the dog screw have returned the predetermined distance to their original vertical position relative to the speaker housing.

In the clamped position, the drive dog, the clamping dog, and the compression spring are once again in the same position relative to each other as in the ready-to-release position. In other words, the drive dog is engaged with the clamping dog, and the compression spring is in a compressed state between the drive dog and the clamping dog, while the dogleg extends out of the outer wall of the speaker housing. However, in the clamped position, the drive dog, clamping dog, and compression spring are now progressed along the length of the dog screw and positioned at the top of the dog tower.

To install a speaker assembly in accordance with the present invention, a speaker assembly is first provided with all of the clamping subassemblies in the parked position. A hole is cut in the mounting surface, such as, for example, a wall or ceiling, which will accommodate the outer wall of the speaker housing, but is smaller than the front lip of the speaker housing. The speaker housing is inserted into the hole until the front lip is in contact with the wall or ceiling.

The operator holds the speaker assembly in place with one hand and engages the head of the dog screw with a screw driver or other similar tool to rotate the screw a one-quarter turn. In doing so, the entire clamping subassembly is rotated a one-quarter turn from the parked position and transitioned into the ready-to-release position with the dogleg now extending out of the outer wall of the speaker housing and the dog screw now projecting out from the speaker housing a predetermined distance.

The operator then pushes the dog screw down (or inward relative to the speaker assembly) which, in turn, causes a downward movement and additional rotation of the drive dog, transitioning the clamping subassembly into the released position. In the released position, the dogleg is now in engaged with the back side of the wall or ceiling (i.e., the wall or ceiling is now between the front lip of the speaker housing and the dogleg) with the force of the compression spring providing a temporary holding force.

The above steps are repeated until all of the clamping subassemblies are in the released position, and the speaker assembly is now temporarily clamped on the wall or ceiling. The dog screw in each clamping subassembly is then rotated further (i.e., driven by a powered driver or other such tool configured to engage the dog screw), transitioning the clamping subassemblies into the clamped position. The dogleg is now engaged with the back side of the wall or ceiling with the dog screw providing a permanent holding force. Advantageously, since the compression spring is fully compressed in the clamped position, when fully installed, the speaker assembly has no loose parts which can rattle during use.

DETAILED DESCRIPTION OF THE INVENTION

The present invention is a speaker assembly, including one or more clamping subassemblies, which substantially prevents potential damage to the speaker during installation and improves the "ease-of-use" during installation.

Figure 1:
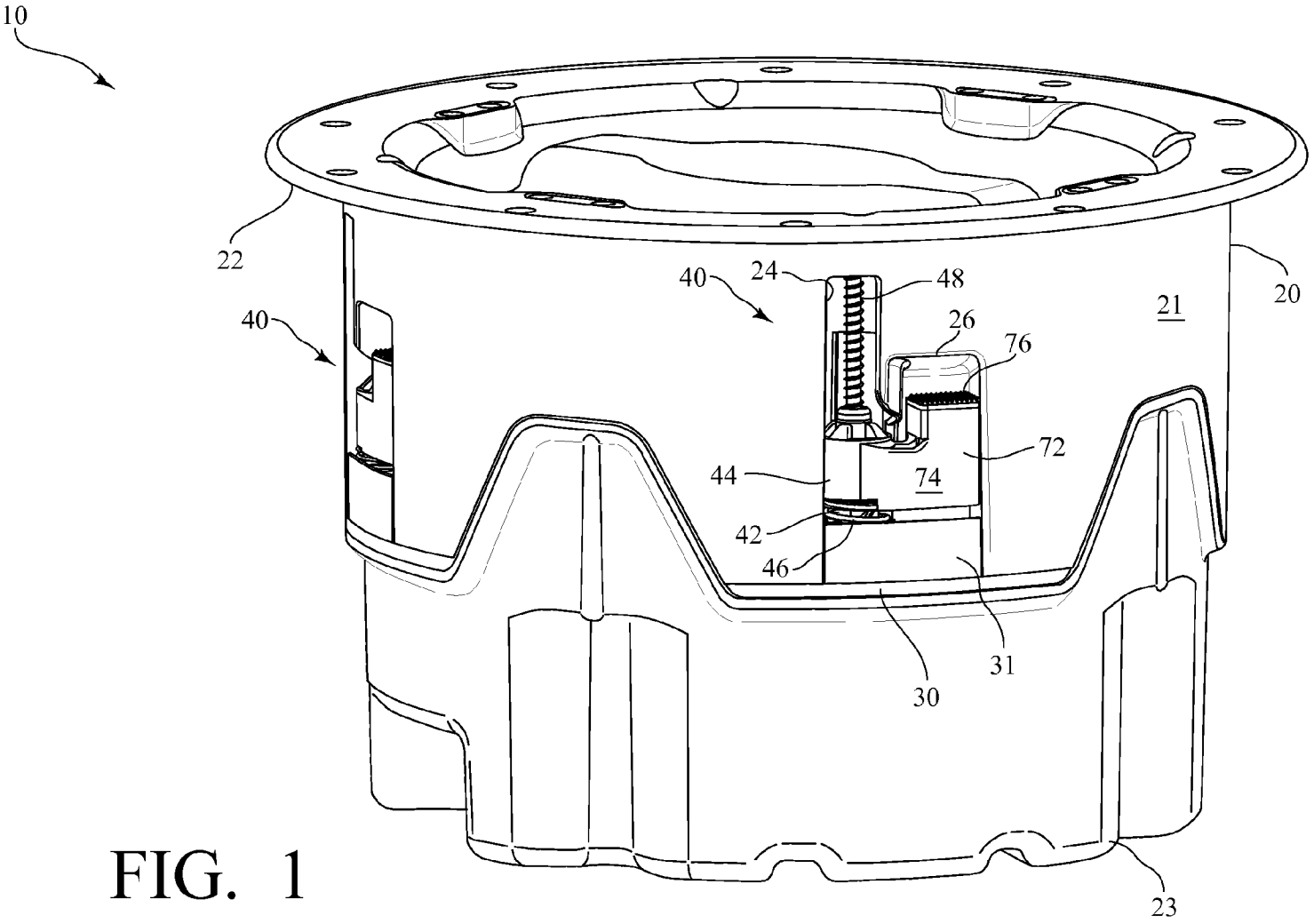
FIG. 1 is a perspective view of an exemplary speaker assembly made in accordance with the present invention.

Referring now to FIG. 1, one exemplary speaker assembly 10 made in accordance with the present invention includes a speaker housing 20 with an outer wall 21 and a front lip (or flange) 22. In this exemplary embodiment, the outer wall 21 is in the form of a cylinder, and the front lip 22 is circular. However, the speaker assembly 10 could take various shapes without departing from the spirit and scope of the present invention. Also, in FIG. 1, the exemplary speaker assembly 10 includes a rear cover 23, but the rear cover has no relevance to the present invention.

Referring still to FIG. 1, the speaker assembly 10 further includes one or more clamping subassemblies 40, each of which is contained in the speaker housing 20. In particular, for each clamping subassembly 40, the speaker housing 20 defines a first cavity referred to as a "dog tower" 24 in the description that follows, and the speaker housing 20 also defines a second cavity referred to as a "clamping dog recess" 26 in the description that follows. The dog tower 24 is a substantially cylindrical cavity defined in the outer wall 21 of the speaker housing 20. The clamping dog recess 26 is defined in the other wall of the speaker housing 20 adjacent to the dog tower 24.

In this exemplary embodiment, four clamping subassemblies 40 are located around the periphery of the speaker housing 20 at 90-degree intervals; however; fewer or more clamping subassemblies 40 may be utilized and/or the clamping subassemblies 40 may be spaced at regular or irregular intervals without departing from the spirit and scope of the present invention. Regardless of the number or positioning of the clamping subassemblies 40, each clamping subassembly 40 includes a drive dog 42, a clamping dog 44 with a dogleg 72 having a dog grip 76 on an upper surface of the dogleg 72, a compression spring 46, and a dog screw 48. As perhaps best shown in FIGS. 6-7, along with FIG. 7C, the compression spring 46 extends and is compressed between the drive dog 42 and the clamping dog 44, and the dog screw 48 extends through the drive dog 42 as well as through the clamping dog 44, as discussed in further detail below. Furthermore, each clamping subassembly 40 is held in position in the speaker housing 20 by a dog tower cap 30 secured to the speaker housing 20 at the bottom of the dog tower 24 and adjacent to the clamping subassembly 40, with a peripheral wall 31 of the dog tower cap 30 substantially flush with the outer wall 21 of the speaker housing 20 when the speaker assembly 10 is assembled.

Figure 2:
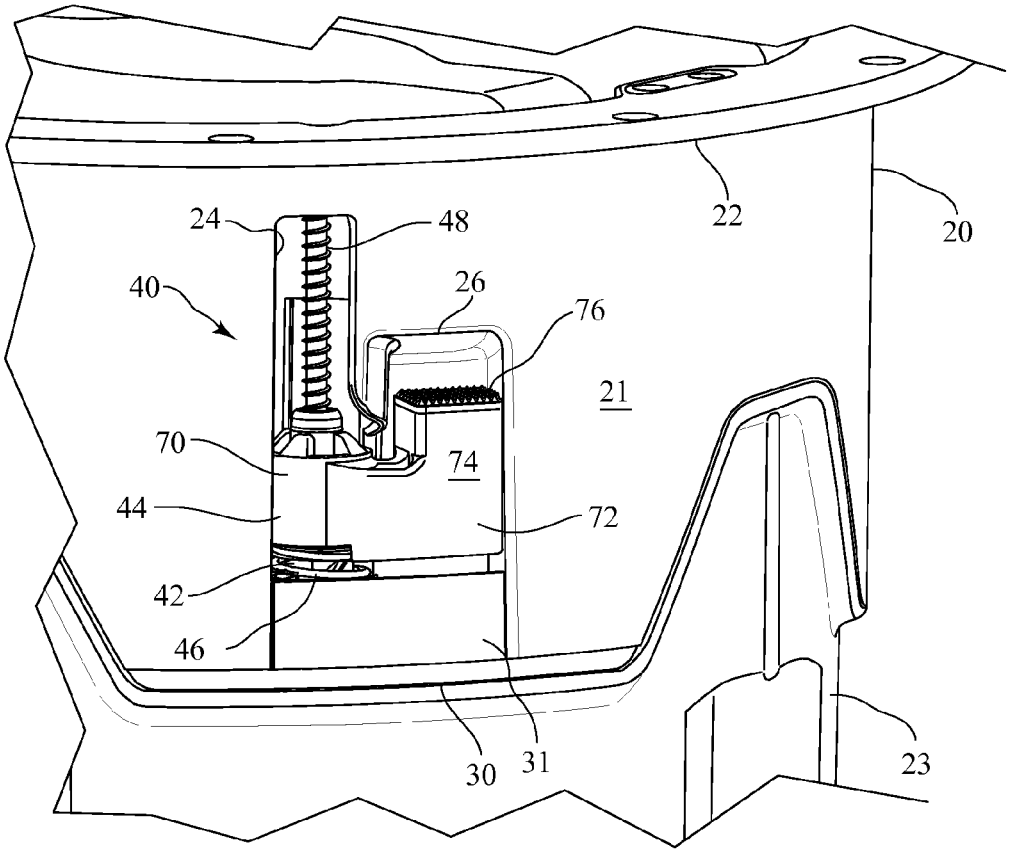
FIG. 2 is an enlarged perspective view of one clamping subassembly housed in the speaker housing of the speaker assembly of FIG. 1, the clamping subassembly shown in a parked position.
Figure 3:
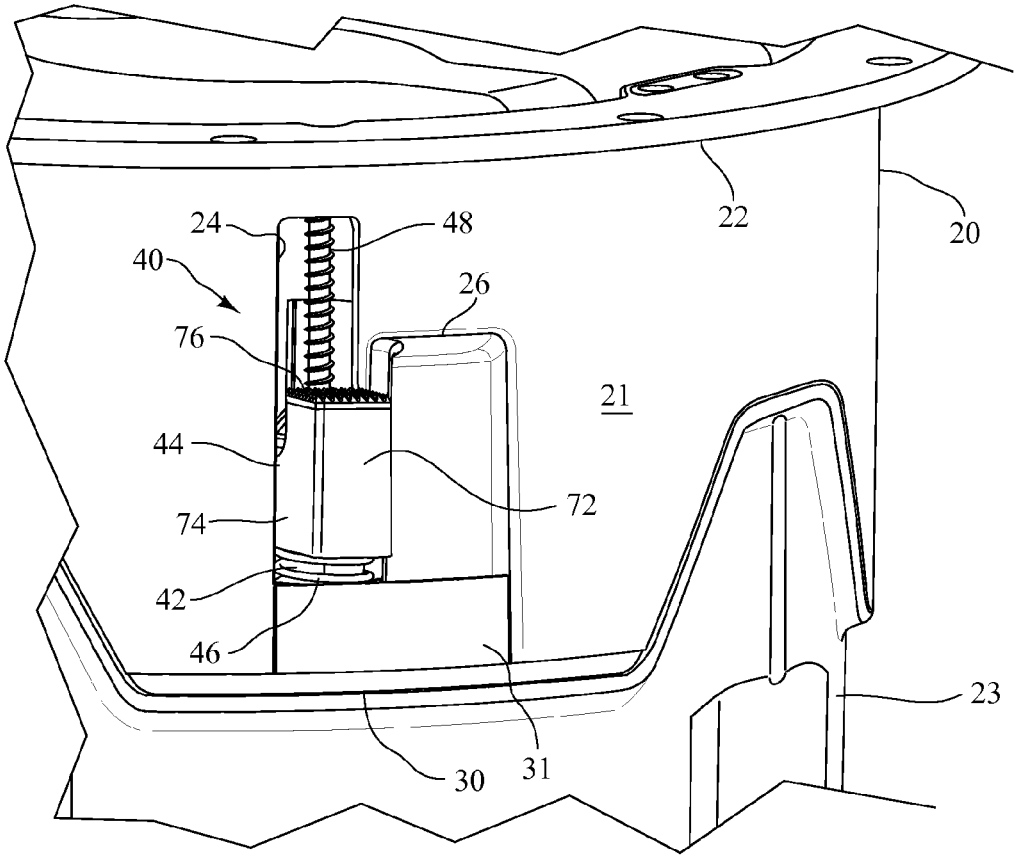
FIG. 3 is an enlarged perspective view of the clamping subassembly of FIG. 2, but wherein the clamping subassembly is in a ready-to-release position.
Figure 4:
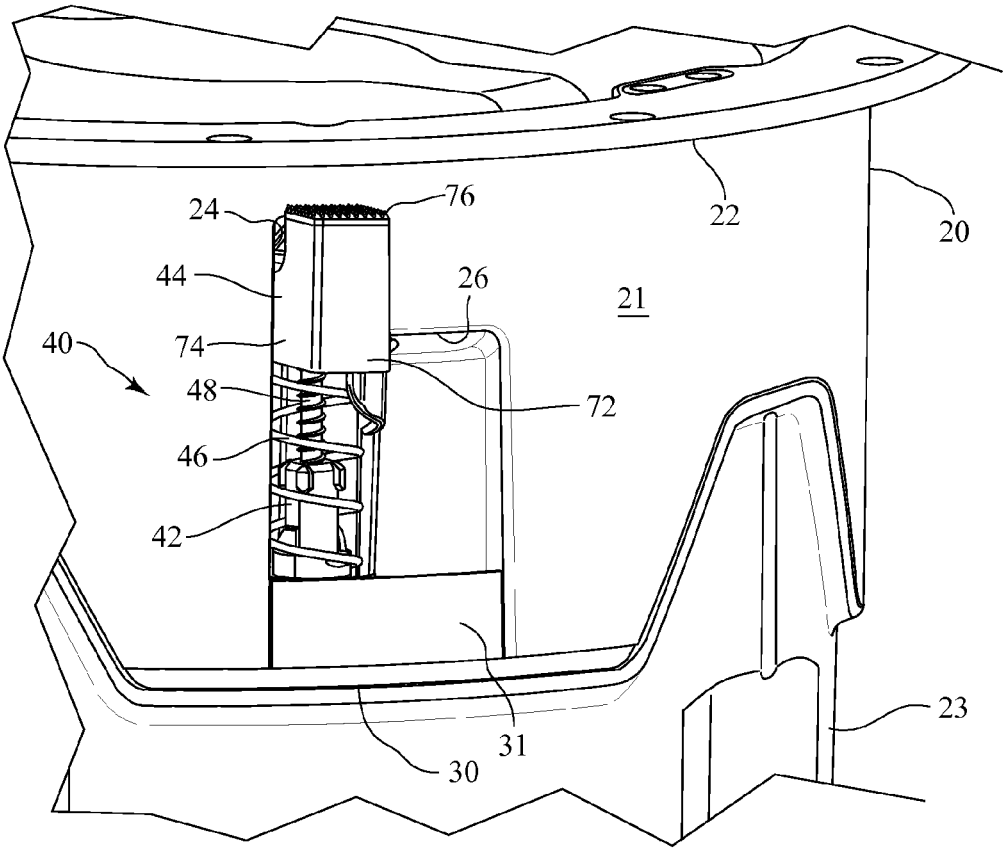
FIG. 4 is an enlarged perspective view of the clamping subassembly of FIG. 2, but wherein the clamping subassembly is in a released position.
Figure 5:
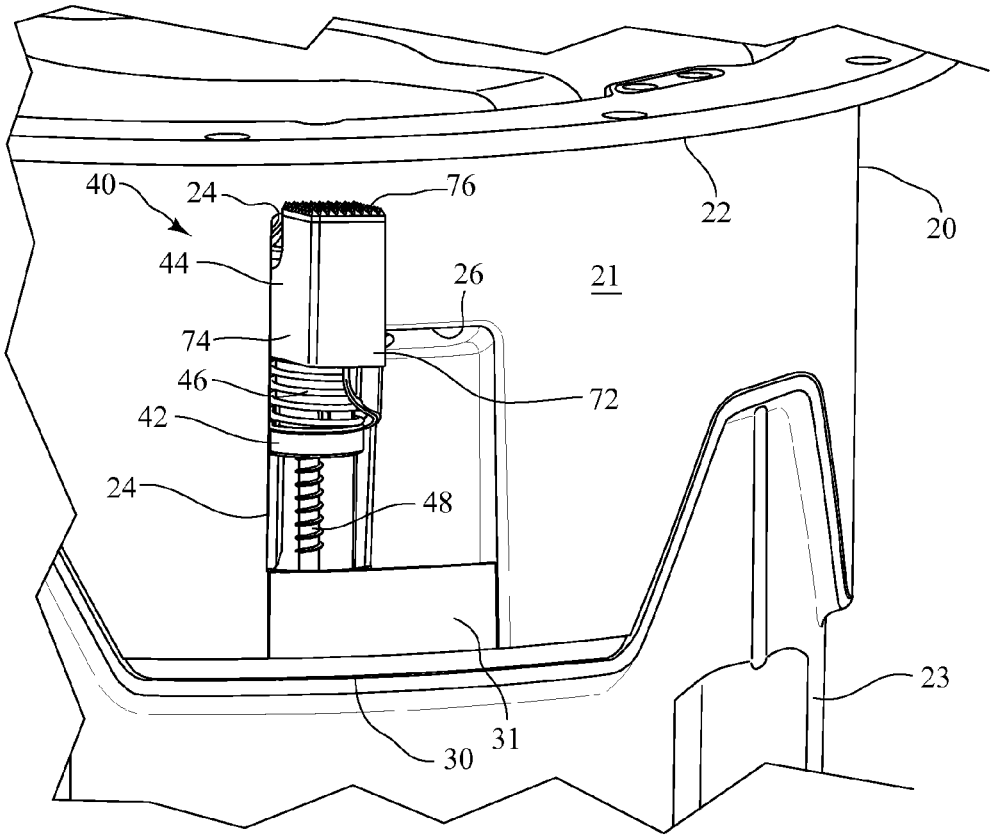
FIG. 5 is an enlarged perspective view of the clamping subassembly of FIG. 2, but wherein the clamping subassembly is in a clamped position.

Referring now to FIGS. 2-5, which each provide an enlarged perspective view of one exemplary clamping subassembly 40, the clamping subassembly 40 is capable of transitioning between four different positions or configurations: a parked position (as shown in FIG. 2); a ready-to-release position (as shown in FIG. 3); a released position (as shown in FIG. 4); and a clamped position (as shown in FIG. 5).

Referring now to FIG. 2, in which the clamping subassembly 40 is in the parked position, the entire clamping subassembly 40 is contained in the speaker housing 20. Specifically, the dogleg 72 of the clamping dog 44 is housed in the clamping dog recess 26 defined by the speaker housing 20, and the rest of the clamping subassembly 40 is housed in the dog tower 24 defined by the speaker housing 20. In this way, in the parked position, no portion of the clamping subassembly 40 extends beyond the boundary defined by the outer wall 21 of the speaker housing 20. Furthermore, in the parked position, the drive dog 42 is engaged with the clamping dog 44, with the compression spring 46 in a compressed state between the drive dog 42 and the clamping dog 44, as discussed in further detail below.

Referring now to FIG. 3, in which the clamping subassembly 40 is in the ready-to-release position, the clamping subassembly 40 is now only partially housed within the speaker housing 20. Specifically, the dogleg 72 of the clamping dog 44 has now rotated around a longitudinal axis defined by the dog screw 48 (discussed in further detail below), and the dogleg 72 of the clamping dog 44 now extends out of the outer wall 21 of the speaker housing 20, with a lateral surface 74 of the dogleg 72 in contact with the speaker housing 20. The rest of the clamping subassembly 40 is still housed in the dog tower 24 with the drive dog 42, the clamping dog 44, and the compression spring 46 in the same position relative to each other as in the parked position, as described above with reference to FIG. 2. In other words, the drive dog 42 is still engaged with the clamping dog 44, with the compression spring 46 in a compressed state between the drive dog 42 and the clamping dog 44. However, in the ready-to-release position, the entire clamping subassembly 40 (i.e., the drive dog 42, clamping dog 44, compression spring 46, and dog screw 48) has moved upward a predetermined distance (in this exemplary embodiment, approximately 0.110") in relation to the speaker housing 20 as compared to when the clamping subassembly 40 was in the parked position, as discussed in further detail below. Consequently, although not shown, the dog screw 48 extends the same predetermined distance out from the speaker housing 20.

Referring now to FIG. 4, in which the clamping subassembly 40 is in the released position, the dogleg 72 still extends out of the outer wall 21 of the speaker housing 20, with the lateral surface 74 of the dogleg 72 in contact with the speaker housing 20, and the rest of the clamping subassembly 40 is still housed in the dog tower 24, similar to the ready-to-release position described above with reference to FIG. 3. However, in the released position, the drive dog 42 has now rotated relative to the speaker housing 20 and the clamping dog 44 as compared to the ready-to-release position described above with reference to FIG. 3. The rotation of the drive dog 42 causes the drive dog 42 to disengage the clamping dog 44, such that the compression spring 46 is released. Accordingly, under the biasing force of the compression spring 46, the clamping dog 44 has now moved to the top of the dog tower 24, while the drive dog 42 is at the bottom of the dog tower 24. The compression spring 46 in now in an uncompressed state between the drive dog 42 and the clamping dog 44, as discussed in further detail below. Furthermore, both the drive dog 42 and the dog screw 48 have returned the predetermined distance to their original vertical position relative to the speaker housing 20.

Referring now to FIG. 5, in which the clamping subassembly 40 is in the clamped position, the dogleg 72 extends out of the outer wall 21 of the speaker housing 20, with a lateral surface 74 of the dogleg 72 in contact with the speaker housing 20, and the rest of the clamping subassembly 40 is still housed in the dog tower 24, similar to the ready-to-release position described above with reference to FIG. 3. In fact, the drive dog 42, the clamping dog 44, and the compression spring 46 are once again in the same position relative to each other as in the ready-to-release position described above with reference to FIG. 3 and the parked position described above with reference to FIG. 2. In other words, the drive dog 42 is engaged with the clamping dog 44, and the compression spring 46 is in a compressed state between the drive dog 42 and the clamping dog 44. However, in the clamped position, the drive dog 42, clamping dog 44, and compression spring 46 are now progressed along the length of the dog screw 48 and positioned at the top of the dog tower 24, as discussed in further detail below.

Figure 6:
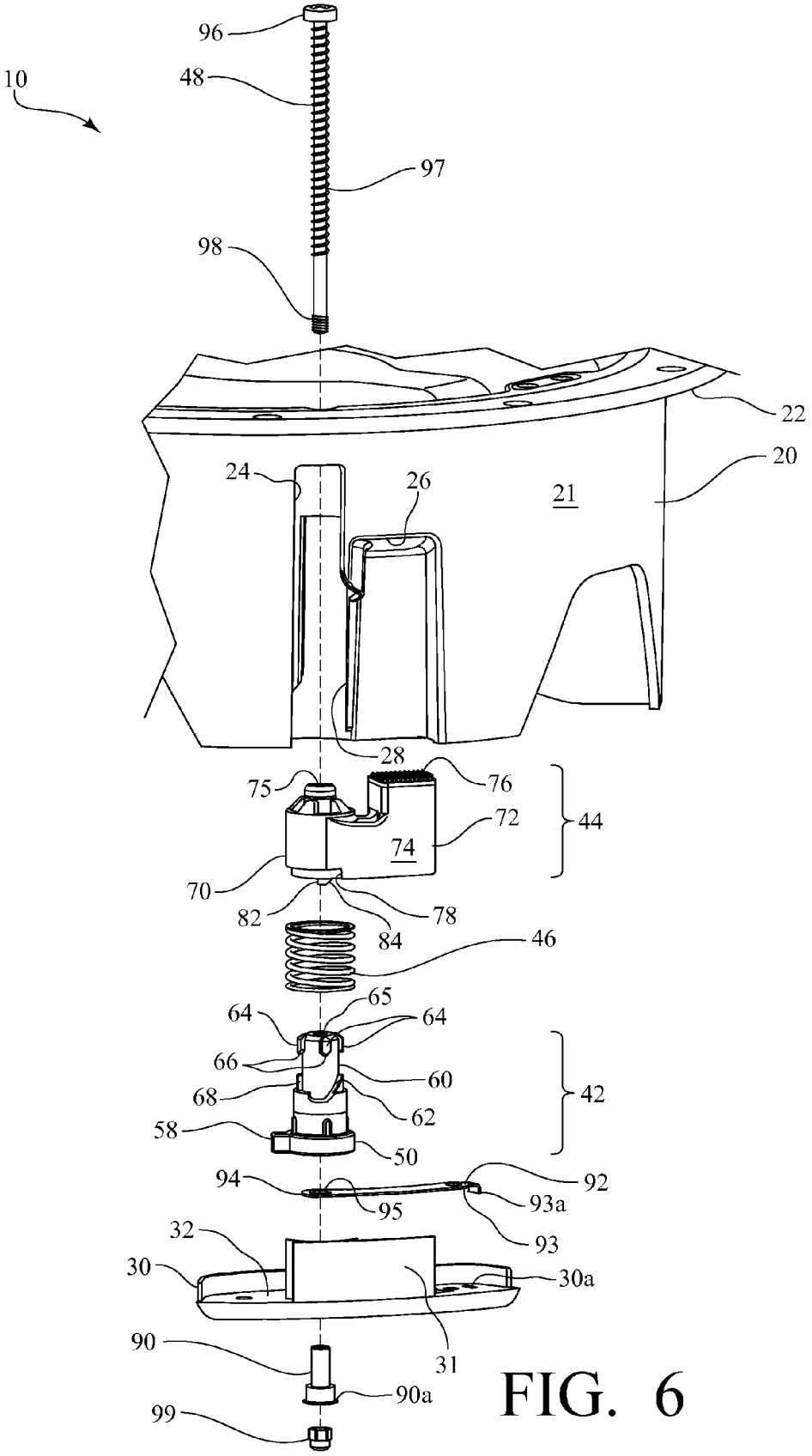
FIG. 6 is a partial exploded view of the speaker assembly of FIG. 2.
Figure 7:
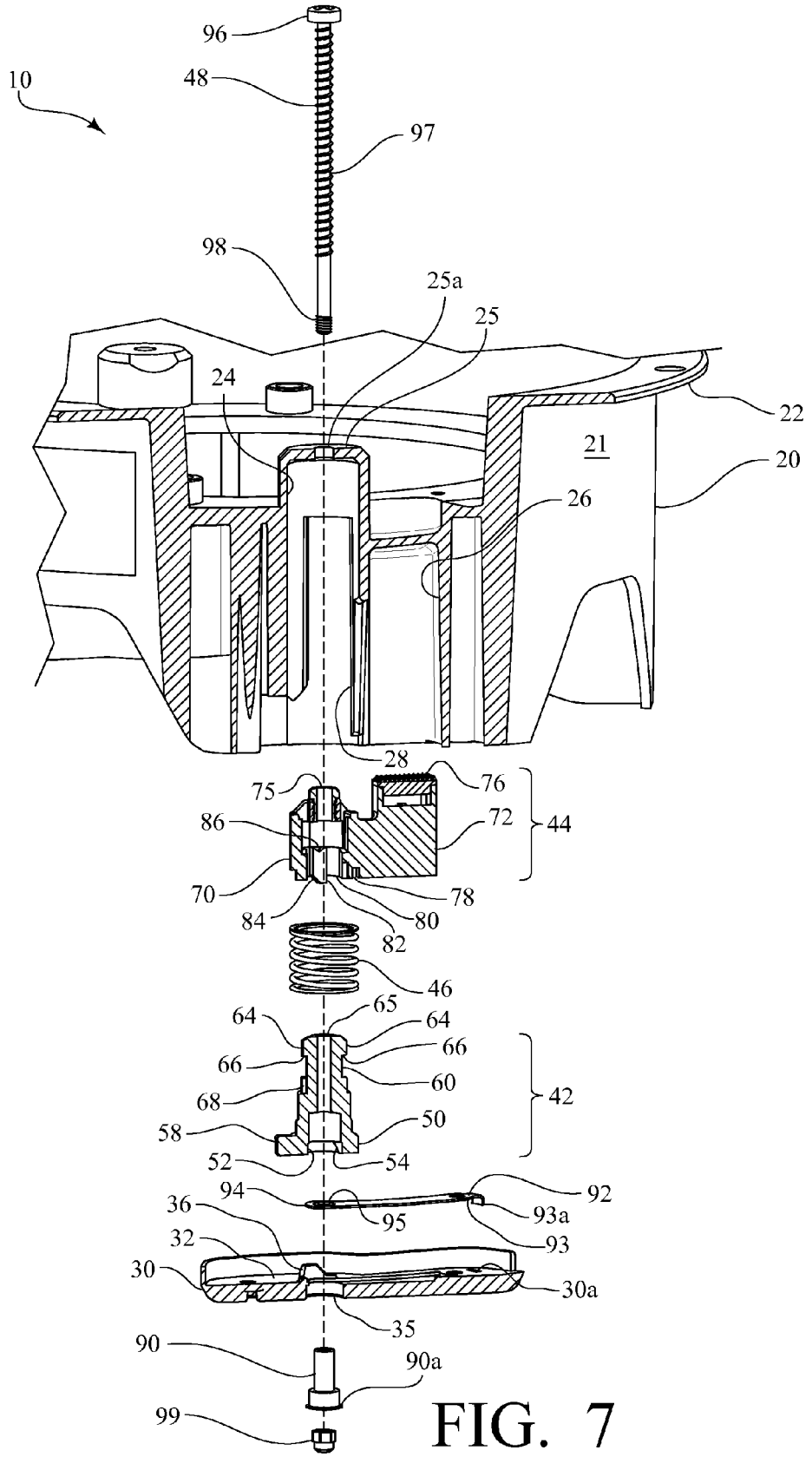
FIG. 7 is a partial sectional view of the exploded speaker assembly of FIG. 6.

Referring now to FIGS. 6-7, and focusing on the speaker housing 20, as described above, the dog tower 24 is a substantially cylindrical cavity defined in the outer wall 21 of the speaker housing 20, with the upper end of the cavity bounded by an upper wall surface 25 which defines a hole 25*a*. A vertical channel 28 is also defined in the speaker housing 20 adjacent to the dog tower 24, which extends from the bottom of the dog tower 24 a predetermined distance along the length of the dog tower 24. In operation, the vertical channel 28 thus extends adjacent and parallel to the clamping subassembly 40, as discussed in further detail below.

Referring still to FIGS. 6-7, as described above, the dog tower cap 30 is secured to the speaker housing 20 at the bottom of the dog tower 24 and adjacent to the clamping subassembly 40. As shown, the dog tower cap 30 defines a hole 35 and has a substantially flat base surface 32 which is positioned adjacent to the speaker housing 20. Furthermore, the peripheral wall 31 extends perpendicularly from the base surface 32 in order to partially enclose the clamping subassembly 40 positioned within the dog tower 24. Furthermore, as shown in FIG. 7, the dog tower cap 30 includes one or more vertical projections 36 positioned around the hole 35 which extend from the base surface 32 of the dog tower cap 30. Although only one vertical projection 36 is shown in FIG. 7, it is contemplated that a second vertical projection substantially identical to the vertical projection 36 shown is positioned on the opposite side of the hole 35.

Figure 8A:
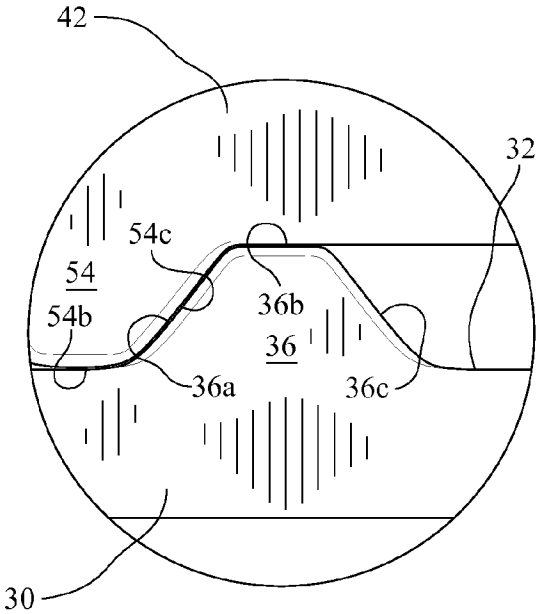
FIG. 8A is an enlarged view of a projection of a drive dog engaging a projection of a dog tower cap of FIG. 2, when the clamping subassembly is in the parked position.
Figure 8B:
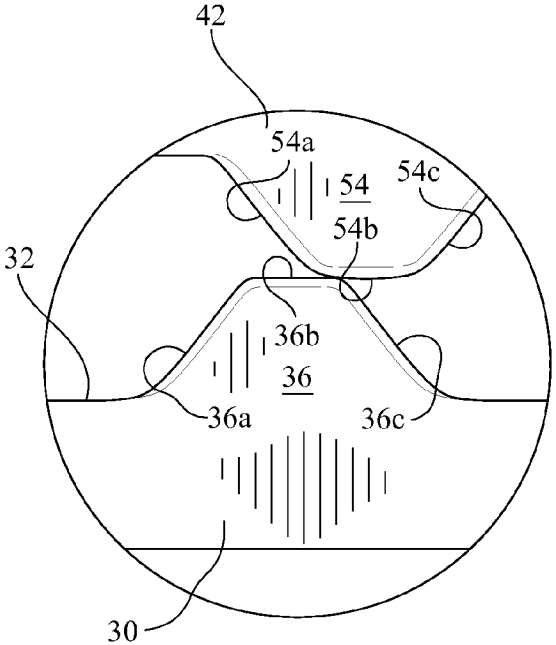
FIG. 8B is an enlarged view of a projection of a drive dog engaging a projection of a dog tower cap of FIG. 3, when the clamping subassembly is in the ready-to-release position.
Figure 8C:
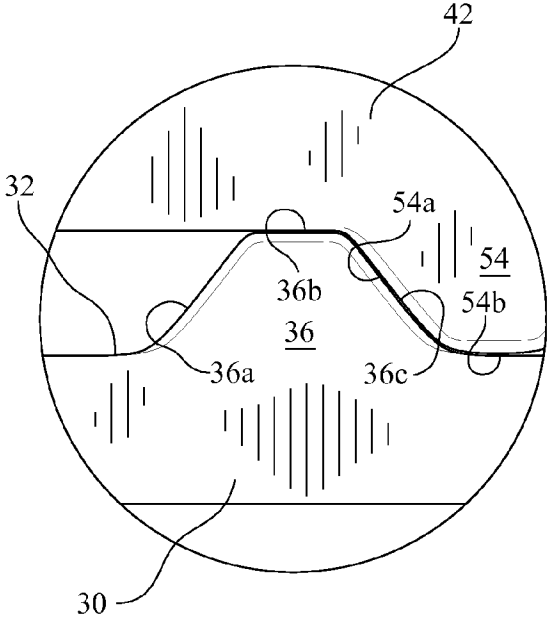
FIG. 8C is an enlarged view of a projection of a drive dog engaging a projection of a dog tower cap of FIG. 4, when the clamping subassembly is in the released position.

Referring now to FIGS. 8A-8C, each projection 36 includes a first sloped (or ramp) surface 36*a* and an alternately sloped second sloped surface 36*c*, separated by a substantially flat (plateau) surface 36*b*. In this exemplary embodiment, the first and second sloped (or ramp) surfaces 36*a*, 36*c* are oriented at approximately 45° relative to the base surface 32 of the dog tower cap 30.

Figure 7B:
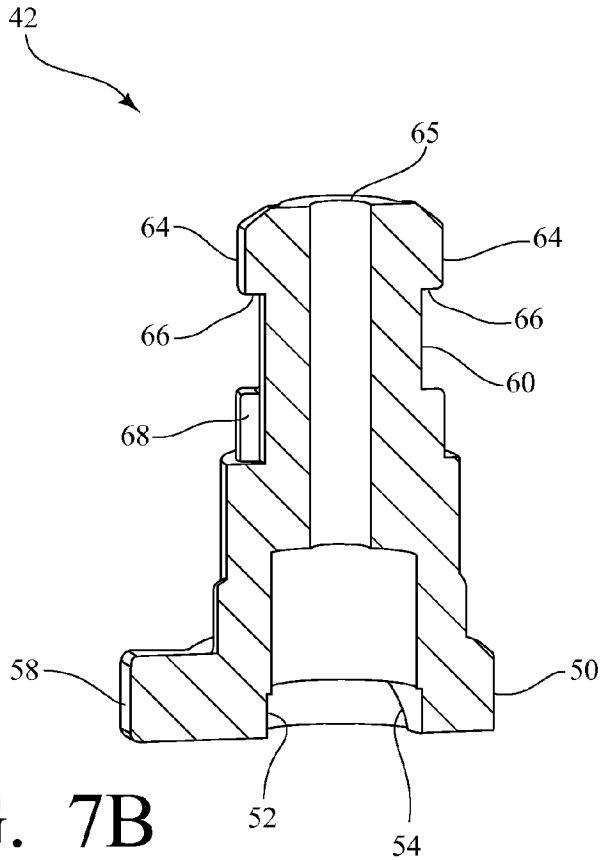
FIG. 7B is an enlarged sectional view of the drive dog of the speaker assembly of FIG. 7.
Figure 7A:
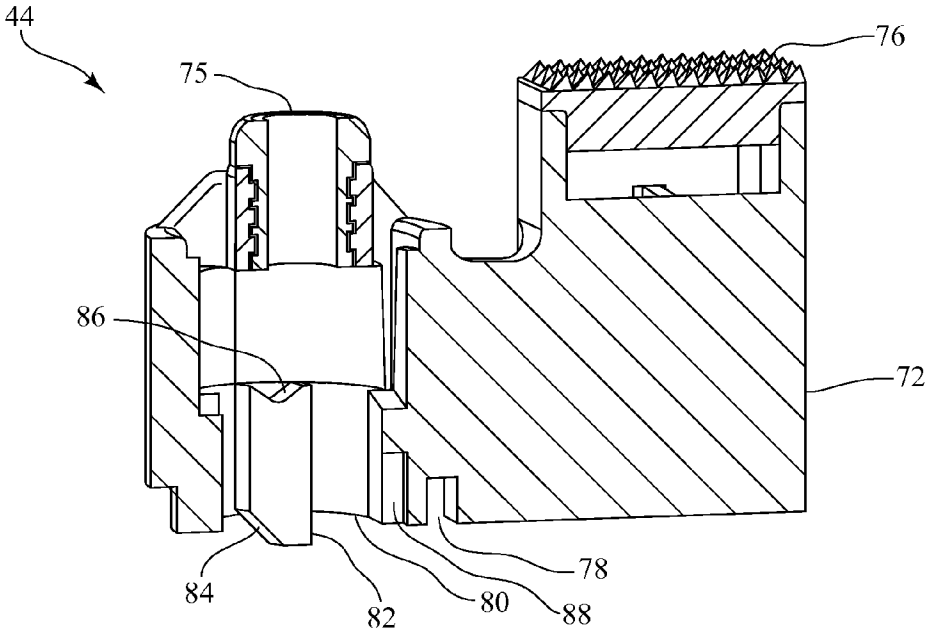
FIG. 7A is an enlarged sectional view of the clamping dog of the speaker assembly of FIG. 7.
Figure 7C:
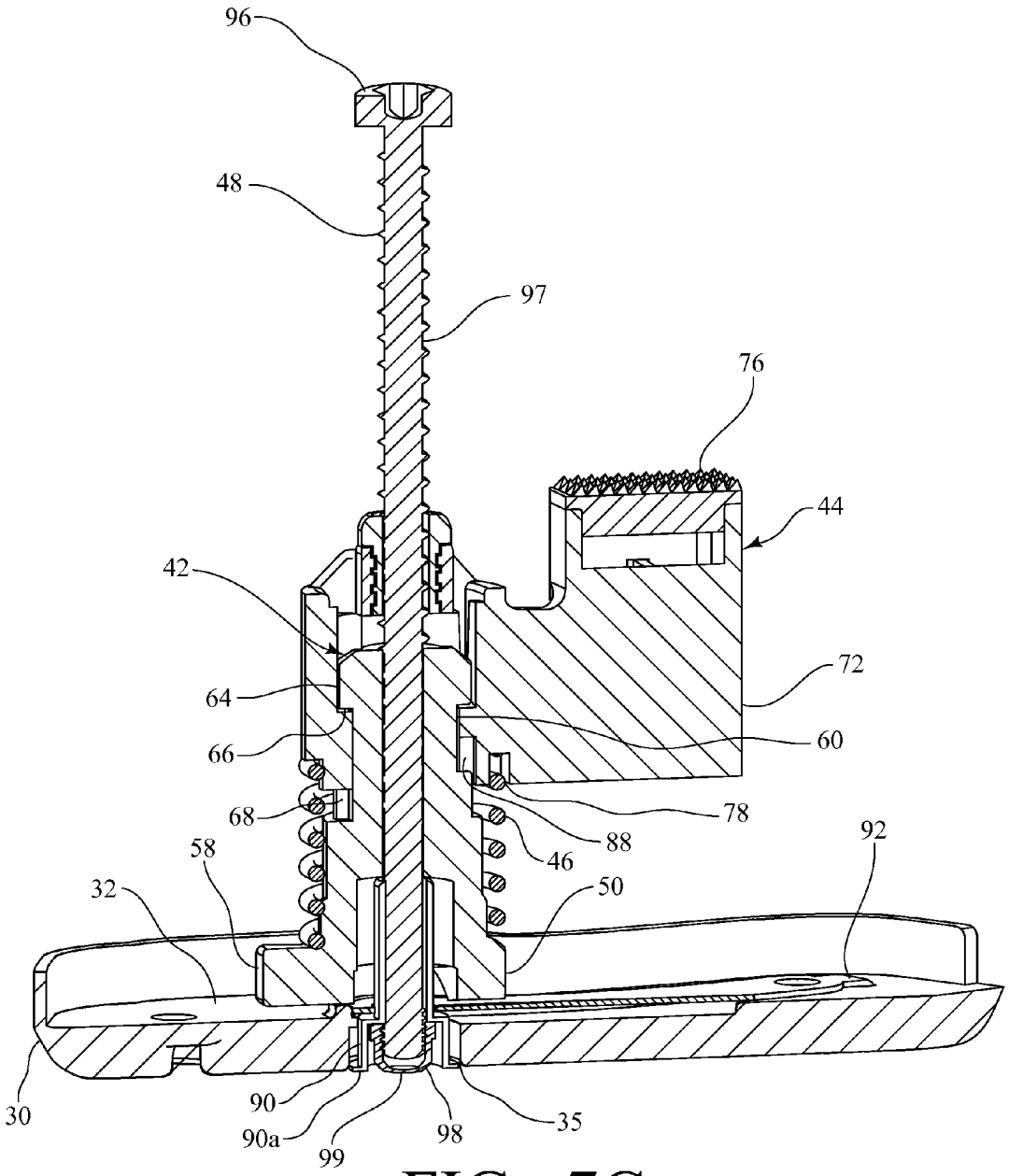
FIG. 7C is a sectional view of certain components of the speaker assembly of FIG. 7 assembled together.

Referring once again to FIGS. 6-7, along with FIG. 7C, a leaf spring 92 is held between the speaker housing 20 and the dog tower cap 30, with a distal end 94 of the leaf spring 92 defining a hole 95 that is aligned with the hole 35 of the dog tower cap 30, and with a fixed end 93 of the leaf spring 92 opposite the distal end 94 that is held in place adjacent to the base surface 32 of the dog tower cap 30. In this exemplary embodiment, the leaf spring 92 includes a downwardly extending tab 93*a* at the fixed end 93 which engages a respective slot 30*a* in the dog tower cap 30 to hold it in place. The hole 95 at the distal end 94 of the leaf spring 92 is configured to receive a bushing 90 that also extends through the hole 35 of the dog tower cap 30, such that the leaf spring 92 provides a biasing force on the bushing 90, as discussed in further detail below.

Referring still to FIGS. 6-7, along with the enlarged view of FIG. 7A, the clamping dog 44 not only includes the dogleg 72, but also includes a cylindrical dog post 70, with the dogleg 72 extending from a lateral surface of the dog post 70. As perhaps best shown in FIG. 7A, the dog post 70 defines a channel 75 along a longitudinal axis of the dog post 70. The dog post 70 further defines a cavity (or dog receptacle) 80, which extends upward a predetermined distance from the bottom of the dog post 70, as well as an annular channel 78 located around the periphery of the cavity 80. Furthermore, there are one or more supports 82 positioned in the cavity 80 which project from the interior surface of the cavity 80 with each support 82 defining a lower inclined surface 84 and an upper seat 86. One such support 82 is shown in detail in FIG. 7A; however, a second support identical to the one support 82 shown in FIG. 7A is positioned on the opposite side of the cavity 80, the lower inclined surface 84 of which, is shown in FIG. 6 extending out of the cavity 80. Additionally, one or more stop surfaces 88 project inward into the cavity 80. One such stop surface 88 is shown in detail in FIG. 7A; however, a second stop surface identical to the one stop surface 88 shown in FIG. 7A is positioned on the opposite side of the cavity 80. In some embodiments, the stop surface 88 may be a lateral surface of the one or more supports 82 positioned in the cavity 80.

Referring once again to FIGS. 6-7, along with the enlarged view of FIG. 7B, the drive dog 42 is comprised of a base portion 50 and a cylindrical body 60 which extends upward from the base portion 50. The base portion 50 of the drive dog 42 includes a tab 58, which extends from an outer surface of the base portion 50 and is configured to engage the vertical channel 28 defined by the speaker housing 20, as discussed in further detail below. The cylindrical body 60 defines two helical surfaces 62 that are configured to engage the lower inclined surfaces 84 of the supports 82 in the cavity 80 defined by the clamping dog 44, as discussed in further detail below. Furthermore, the two helical surfaces 62 terminate at the top of vertical ends 68 which are configured to engage the stop surfaces 88 positioned in the cavity 80 of the clamping dog 44, as discussed in further detail below.

At a distal end of the cylindrical body 60, there are one or more detents 64 which project from the outer surface of the cylindrical body 60 and are configured to engage the supports 82 located in the cavity 80 defined by the clamping dog 44. Specifically, each detent 64 has a lower surface 66 with two angled sides which form an apex on the lower surface 66 of the detent 64 that engages the upper seat 86 of the supports 82 of the clamping dog 44, as discussed in further detail below.

Referring still to FIG. 7B, the cylindrical body 60 of the drive dog 42 defines a channel 65 along a longitudinal axis of the cylindrical body 60 of the drive dog 42. Furthermore, the base portion 50 of the drive dog 42 defines a cylindrical cavity 52 which extends from a bottom surface of the base portion 50. As perhaps best shown in the enlarged views of FIGS. 8A-8C, one or more projections 54 extend downward from an interior surface of the cavity 52. Each of these one or more projections 54 has a first sloped surface 54*a* and an alternately sloped second sloped surface 54*c* separated by a substantially flat (plateau) surface 54*b*. The first and second sloped surfaces 54*a*, 54*b* are oriented at approximately 45° relative to the bottom surface of the base portion 50 of the drive dog 42 and are configured to engage the projections 36 which extend from the base surface 32 of the dog tower cap 30, as discussed in further detail below.

Referring once again to FIGS. 6-7, along with FIG. 7C, one end of the compression spring 46 engages the annular channel 78 defined by the clamping dog 44, and the other end engages the base portion 50 of the drive dog 42, such that the cylindrical body 60 of the drive dog 42 is contained within the compression spring 46.

Referring still to FIGS. 6-7, along with FIG. 7C, the dog screw 48 includes a head 96, a left-hand-threaded distal end 98 with a right-hand-threaded shaft 97 extending between the head 96 and the distal end 98. In some embodiments, the threaded shaft 97 of the dog screw 48 is a threaded rolling screw designed for use with plastics, such as, for example a Plastite® screw, with a length of approximately 3.25 inches. (Plastite® is a registered trademark of Research Engineering & Manufacturing Inc. of Middletown, R.I.). The remainder of the dog screw 48 includes the left-hand-threaded distal end 98 and a non-threaded portion which together are approximately 0.75 inches long. In operation, the dog screw 48 is positioned with the head 96 of the dog screw 48 adjacent to an exterior surface of the speaker housing 20, and with the shaft 97 of the dog screw 48 extending through the hole 25*a* defined by the upper wall surface 25 of the dog tower 24, through the channel 75 defined by the dog post 70, through the channel 65 defined by the drive dog 42, and into the bushing 90 positioned within the hole 35 defined by the flat base surface 32 of the dog tower cap 30. The right-handed threads of the shaft 97 of the dog screw 48 frictionally engage the channel 65 defined by the drive dog 42, but do not engage the dog post 70 of the clamping dog 44. In this way, rotation of the dog screw 48 results in rotation of the drive dog 42, but the clamping dog 44 is capable of freely rotating around and sliding along the length of the dog screw 48, as discussed in further detail below. The left-hand-threaded distal end 98 of the dog screw 48 is held in place in the bushing 90 by a fastener 99, such as, for example, an acorn nut, and preferably secured with thread lock to prevent the fastener 99 from loosening during the operational life of the speaker assembly 10.

Referring still to FIGS. 6-7, along with FIG. 7C, when the drive dog 42 is engaged with the clamping dog 44 (i.e., when the clamping subassembly 40 is in the parked, ready-to-release, or clamped positions), the cylindrical body 60 of the drive dog 42 is substantially contained within the cavity 80 defined by the clamping dog 44. Furthermore, the detents 64 of the drive dog 42 are engaged with the upper seats 86 defined by the supports 82 of the clamping dog 44, and the tab 58 on the drive dog 42 is positioned directly opposite from the dogleg 72 of the clamping dog 44. The compression spring 46 is in a compressed state, which provides a force which holds the apex on the lower surface 66 of the detents 64 in the upper seat 86 of the supports 82 to securely hold the drive dog 42 in the cavity 80 defined by the clamping dog 44. Specifically, the engagement of the upper seat 86 by the apex on the lower surface 66 of the detents 64 securely holds the drive dog 42 in the cavity 80 defined by the clamping dog 44 by resisting rotation of the drive dog 42 relative to the clamping dog 44.

Referring now to FIG. 8A, when the clamping subassembly 20 is in the parked position (FIG. 2), the projections 54 of the drive dog 42 are mated with the projections 36 of the dog tower cap 30, such that the second sloped surface 54*c* of each drive dog projection 54 is in substantial contact with the first sloped surface 36*a* of a respective projection 36 of the dog cap tower 30. Although such mating of the projections 54 of the drive dog 42 with the projections 36 of the dog tower cap 30 is used in this exemplary embodiment, in some embodiments, such as those embodiments in which the force supplied by the compression spring 46 is minimal, such projections 36, 54 may not be necessary, as discussed in further detail below.

Figure 9A:
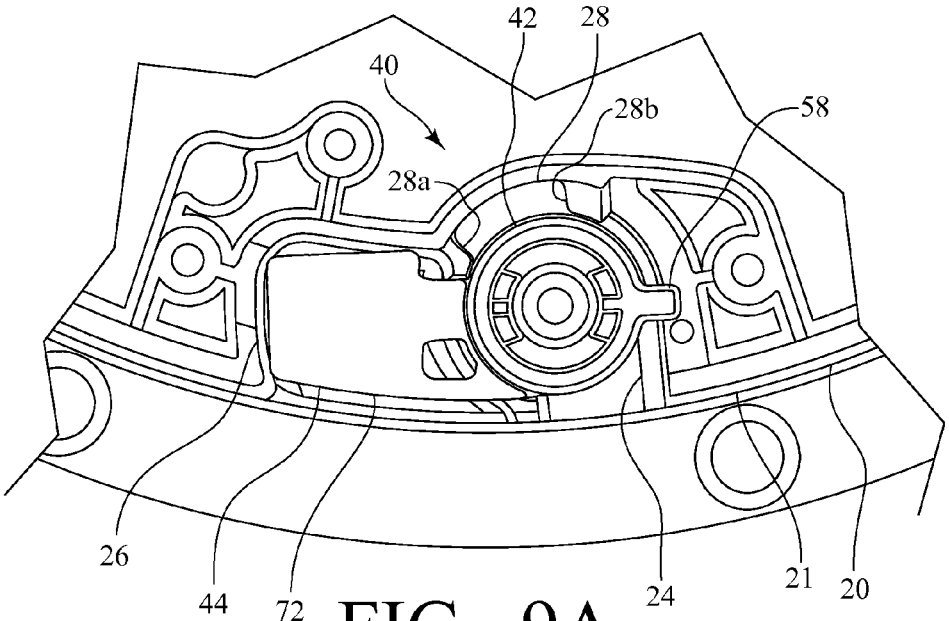
FIG. 9A is a partial, enlarged bottom view of the drive dog, clamping dog, and speaker housing, when the clamping subassembly of FIG. 2 is in the parked position.

FIG. 9A is a partial, enlarged bottom view of the clamping subassembly 40 in the parked position. As described above, in the parked position, no portion of the clamping subassembly 40 extends beyond the boundary defined by the outer wall 21 of the speaker housing 20. Furthermore, in the parked position, the drive dog 42 and the dog post 70 of the clamping dog 44 are housed in the dog tower 24, and the dogleg 72 of the clamping dog 44 is housed in the clamping dog recess 26. The tab 58 on the drive dog 42 is positioned directly opposite from the dogleg 72 of the clamping dog 44 and is not aligned with the vertical channel 28 defined by the speaker housing 20.

Through an initial rotation of the dog screw 48, the clamping subassembly 40 is transitioned from the parked position (FIG. 2) to the ready-to-release position (FIG. 3). In this exemplary embodiment, the initial rotation of the dog screw 48 is about a one-quarter turn. As shown in FIG. 8B, such initial rotation of the dog screw 48 causes the second sloped surfaces 54*c* of the projections 54 within the cavity 52 defined by drive dog 42 to move upward along the first sloped surfaces 36*a* of the projections 36 which extend from the base surface 32 of the dog tower cap 30, until the substantially flat (plateau) surface 54*b* of each projection 54 of the drive dog 42 abuts the corresponding substantially flat (plateau) surface 54*b* of each projection 36 which extends from the base surface 32 of the dog tower cap 30, with the first sloped surfaces 54*a* of the projections 54 within the cavity 52 defined by drive dog 42 substantially aligned with the second sloped surfaces 36*c* of the projections 36 which extend from the base surface 32 of the dog tower cap 30. As a result of such movement, the drive dog 42 moves away from the dog tower cap 30, and the clamping subassembly 40 is thus raised a predetermined distance relative to the speaker housing 20, as compared to when the clamping subassembly 40 was in the parked position, such that the dog screw 48 extends out from the speaker housing 20. In this exemplary embodiment, the head 96 of the dog screw 48 now projects out from the speaker housing 20 approximately 0.110".

Figure 9B:
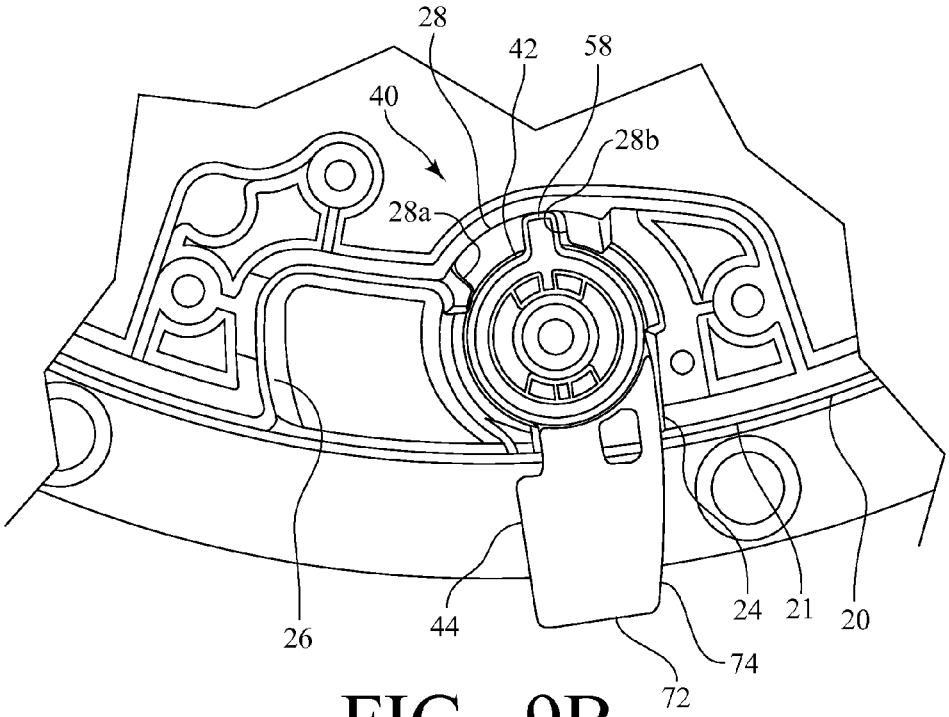
FIG. 9B is a partial, enlarged bottom view of the drive dog, clamping dog, and speaker housing of FIG. 3, when the clamping subassembly is in the ready-to-release position.

The leaf spring 92 provides an upward biasing force which helps maintain the clamping subassembly 40 in the parked position until the dog screw 48 is initially rotated. Specifically, and as described above with reference to FIGS. 6, 7, and 7C, the right-handed threads of the shaft 97 of the dog screw 48 frictionally engage the channel 65 defined by the drive dog 42 and, therefore, in the parked position. each portion of the clamping subassembly 40 (i.e., the drive dog 42, clamping dog 44, compression spring 46, and dog screw 48) is held in position relative to every other portion of the clamping subassembly 40. Furthermore, because the distal end 98 of the dog screw 48 is held in place in the bushing 90, any upward movement of the dog screw 48 results in the bushing 90 also moving upward and causing the leaf spring 92 to flex. The flexure creates a biasing force on the bushing 90 which prevents any unintentional upward movement of the clamping subassembly 40. Finally, as perhaps best shown in FIG. 6, the bushing 90 preferably includes a circumferential lip (or flange) 90*a* which prevents the bushing 90 from passing completely through the hole 35 of the dog tower cap 30. Accordingly, the dog screw 48 cannot be ejected from the clamping subassembly 40, and indeed, is prevented from extending from the front of the speaker housing 20 past a predetermined distance. FIG. 9B is a partial, enlarged bottom view of the clamping subassembly 40 in the ready-to-release position. As described above, in the ready-to-release position, the clamping subassembly 40 is now only partially housed within the speaker housing 20. Specifically, the dogleg 72 of the clamping dog 44 has now rotated around a longitudinal axis defined by the dog screw 48, and the dogleg 72 of the clamping dog 44 now extends out of the outer wall 21 of the speaker housing 20, with a lateral surface 74 of the dogleg 72 in contact with the speaker housing 20. The rest of the clamping subassembly 40 is still housed in the dog tower 24 with the drive dog 42, the clamping dog 44, and the compression spring 46 in the same position relative to each other as in the parked position. However, as a result of the initial rotation, the tab 58 is now aligned with the vertical channel 28 defined by the speaker housing 20.

Now, after the initial rotation of the dog screw 48 and the transition from the parked position to the ready-to-release position, the dog screw 48 can be actuated to transition the clamping subassembly 40 from the ready-to-release position to the released position. In this exemplary embodiment, the dog screw 48 is actuated by applying a downward force to the dog screw 48, which, in turn, causes a corresponding downward movement of the drive dog 42. Referring now to FIG. 8C, in doing so, the first sloped surfaces 54*a* of the projections 54 within the cavity 52 of drive dog 42 slide along the second sloped surfaces 36*c* of the projections 36 which extend from the base surface 32 of the dog tower cap 30 and cause the drive dog 42 to rotate approximately 45° further. Because the lateral surface 74 of the dogleg 72 is in contact with the speaker housing 20 (as shown in FIGS. 3 and 9B), the clamping dog 44 is unable to rotate along with the drive dog 42, and so the detents 64 of the drive dog 42 are forced out of the upper seats 86 in the supports 82 of the clamping dog 44. Once the detents 64 leave the upper seats 86, the compression spring 46 is released. The compression spring 46 then forces the clamping dog 44 along the length of the dog screw 48 and upward relative to the speaker housing 20. The clamping subassembly 40 is now in the released position.

It is contemplated that, in embodiments in which there are no such projections, 36, 54, actuation of the dog screw 48 is accomplished solely through rotating the dog screw 48, and consequently, the drive dog 42 the additional 45°. That being said, the projections 36, 54 are preferred as they provide a mechanical advantage which facilitates overcoming the force of the compression spring 46 that holds the detents 64 of the drive dog 42 in the upper seats 86 of the supports 82 of the clamping dog 44.

Figure 9C:
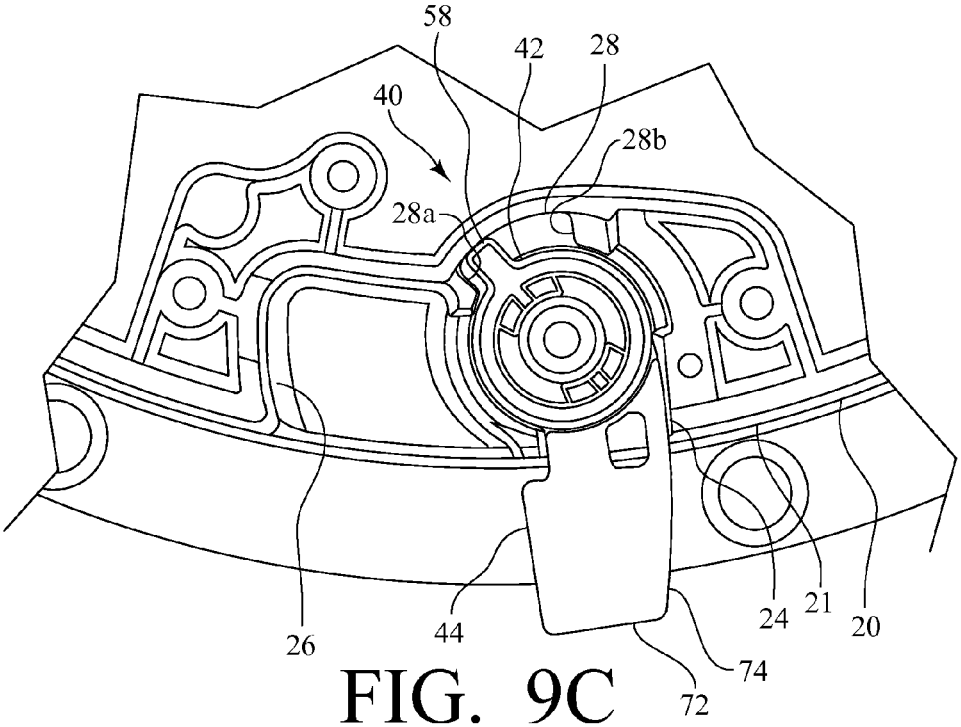
FIG. 9C is a partial, enlarged bottom view of the drive dog, clamping dog, and speaker housing of FIG. 4, when the clamping subassembly is in the released position.

FIG. 9C is a partial, enlarged bottom view of the clamping subassembly 40 in the released position. As described above, in the released position, the drive dog 42 has now rotated approximately 45° further relative to the speaker housing 20, while the clamping dog 44 remains in the same position, as compared to the ready-to-release position. Accordingly, the tab 58 on the drive dog 42 is no longer positioned directly opposite from the dogleg 72 of the clamping dog 44. Furthermore, the tab 58 is now positioned within and engages a side wall 28*a* of the vertical channel 28 defined by the speaker housing 20. The engagement of the tab 58 with the side wall 28*a* of the vertical channel 28 prevents the drive dog 42 from rotating any further.

Referring once again to FIGS. 4 and 5, through further rotation of the dog screw 48, the clamping subassembly 40 is transitioned from the released position to a clamped position. As previously described, the right-handed threads of the shaft 97 frictionally engage the channel 65 defined by the drive dog 42; however, because the tab 58 of the drive dog 42 is engaged with the sidewall 28*a* of the vertical channel 28 defined by the speaker housing 20, the drive dog 42 can no longer rotate along with the dog screw 48. Instead, the threads on the dog screw 48 act to progress the drive dog 42 along the length of the dog screw 48. As the drive dog 42 rises into the clamping dog 44, the detents 64 of the drive dog 42 pass between the supports 82 in the cavity 80 of the clamping dog 44, and the compression spring 46 is compressed between the drive dog 42 and the clamping dog 44.

Figure 9D:
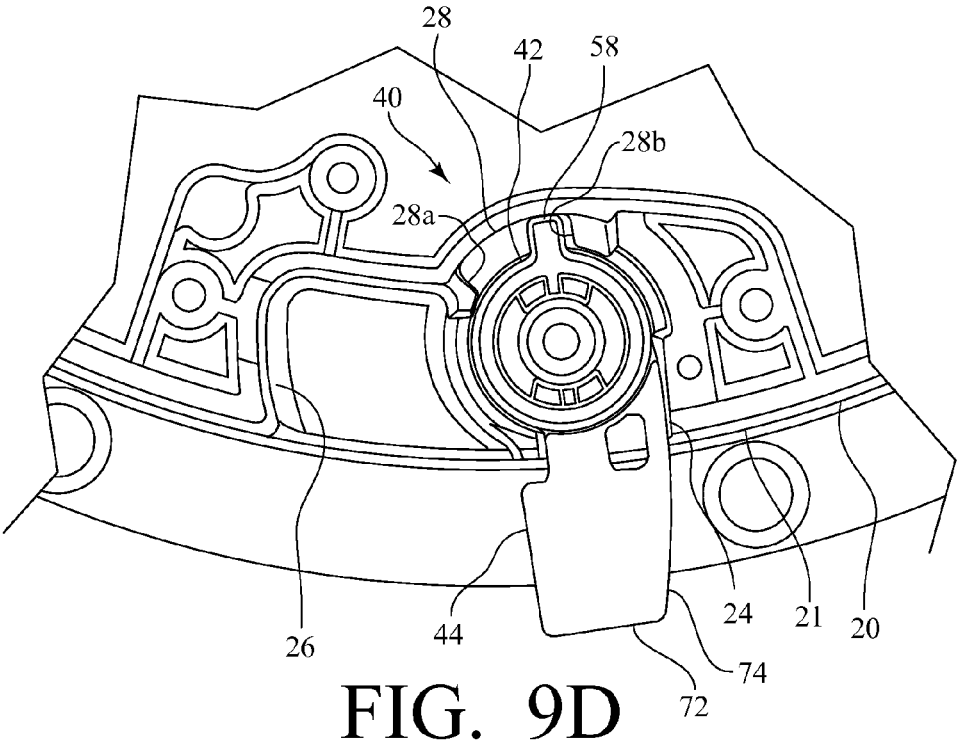
FIG. 9D is a partial, enlarged bottom view of the drive dog, clamping dog, and speaker housing of FIG. 5, when the clamping subassembly is in the clamped position.

After the detents 64 are above the level of the upper seats 86 of the supports 82, the helical surfaces 62 on the exterior of the cylindrical body 60 of the drive dog 42 are engaged by the lower inclined surface 84 of the supports 82 on the clamping dog 44, thus causing the drive dog 42 to rotate relative to the clamping dog 44 as the drive dog 42 rises further into the clamping dog 44. The rotation of the drive dog 42 in relation to the clamping dog 44 continues until the stop surfaces 88 in the cavity 80 of the clamping dog 44 engage the vertical ends 68 of the drive dog 42, thus preventing any further rotation. At this point, the detents 64 of the drive dog 42 are above the supports 82 and reengaged with the upper seats 86 of the supports 82. In this manner, the clamping subassembly 40 is now in the clamped position, with the drive dog 42 fully engaged with the clamping dog 44, and the compression spring 46 is fully compressed. Furthermore, as shown in FIG. 9D, the tab 58 of the drive dog 42 is once again aligned with the dogleg 72 of the clamping dog 44 and is now engaging the opposite side wall 28*b* of the vertical channel 28 defined by the speaker housing 20.

Referring once again to FIGS. 2-5, to install a speaker assembly in accordance with the present invention, a speaker assembly 10 is first provided with all of the clamping subassemblies 40 in the parked position. A hole is cut in the mounting surface, such as, for example, a wall or ceiling, which will accommodate the outer wall 21 of the speaker housing 20, but is smaller than the front lip 22 of the speaker housing 20. The speaker housing 20 is inserted into the hole until the front lip 22 is in contact with the wall or ceiling.

The operator holds the speaker assembly 10 in place with one hand and engages the head 96 of the dog screw 48 with a screw driver or other similar tool to rotate the screw one-quarter turn. In doing so, the entire clamping subassembly 40 is rotated a one-quarter turn from the parked position (FIG. 2) and transitioned into the ready-to-release position (FIG. 3), with the dogleg 72 now extending out of the outer wall 21 of the speaker housing 20, and with the dog screw 48 now projecting out from the speaker housing 20 approximately 0.110".

The operator then pushes the dog screw 48 down (or inward relative to the speaker assembly 10), which, in turn, causes a downward movement and additional rotation of the drive dog 42, transitioning the clamping subassembly 40 into the released position (FIG. 4). In the released position, the dog grip 76 on the upper surface of the dogleg 72 is now engaged with the back side of the wall or ceiling (i.e., the wall or ceiling is now between the front lip 22 of the speaker housing 20 and the dogleg 72) with the force of the compression spring 46 providing a temporary holding force.

The above steps are repeated until all of the clamping subassemblies 40 are in the released position, and the speaker assembly 10 is now temporarily clamped on the wall or ceiling. Advantageously, the above steps require minimal movement on the part of the operator (i.e., a one-quarter turn and a 0.110" push on each dog screw 48), which can easily be accomplished with one hand while the other hand holds the speaker assembly 10 firmly against the wall or ceiling.

At this point, the operator is free to stop holding the speaker assembly 10, as the combined force of the compression spring 46 of each clamping subassembly 40 provides enough force to hold the speaker assembly 10 in place. During this temporary clamped state, the operator may adjust the position of the speaker assembly 10 relative to the wall or ceiling prior to the final clamping step; for example, a round speaker may be rotated prior to final clamping. Furthermore, the operator now has two hands available to operate a power tool, such as a powered driver, to complete the installation process.

The dog screw 48 is now rotated further (i.e., driven by the powered driver or other such tool configured to engage the dog screw 48), transitioning the clamping subassemblies 40 into the clamped position (FIG. 5). The dog grip 76 on the dogleg 72 of each clamping subassembly 40 is now engaged with the back side of the wall or ceiling, with the dog screw 48 providing a permanent holding force. Advantageously, since the compression spring 46 is fully compressed in the clamped position, when fully installed, the speaker assembly 10 has no loose parts which can rattle during use.

Yet another advantage of the present invention is the capability to reverse the installation procedures to remove the speaker assembly 10 from the wall or ceiling. The process for removal of the speaker assembly 10 begins with a speaker assembly 10 installed in the wall or ceiling with all of the clamping subassemblies 40 in the clamped position. As the tab 58 of the drive dog 42 is still located within the vertical channel 28 defined by the speaker housing 20 (as shown in FIG. 9D), reversing the rotation of the dog screw 48 will progress the drive dog 42 down the length of the axis of the dog screw 48. The detents 64 of the drive dog 42 are fully engaged with the upper seats 86 in the supports 82 of the clamping dog 44, and so the clamping dog 44 is drawn downward along with the drive dog 42. Once the tab 58 of the drive dog 42 passes out of the vertical channel 28 (i.e., the clamping subassembly 40 is in the ready-to-release position), the drive dog 42 and the clamping dog 44 are once again capable of rotating relative to the speaker housing 20. In this manner, the clamping subassembly 40 is now returned to the parked position, with the dogleg 72 housed in the clamping dog recess 26 and the rest of the clamping subassembly 40 housed in the dog tower 24, such that no portion of the clamping subassembly 40 extends beyond the boundary defined by the outer wall 21 of the speaker housing 20. The speaker assembly 10 may now be removed from the hole in the wall or ceiling.

Figure 10:
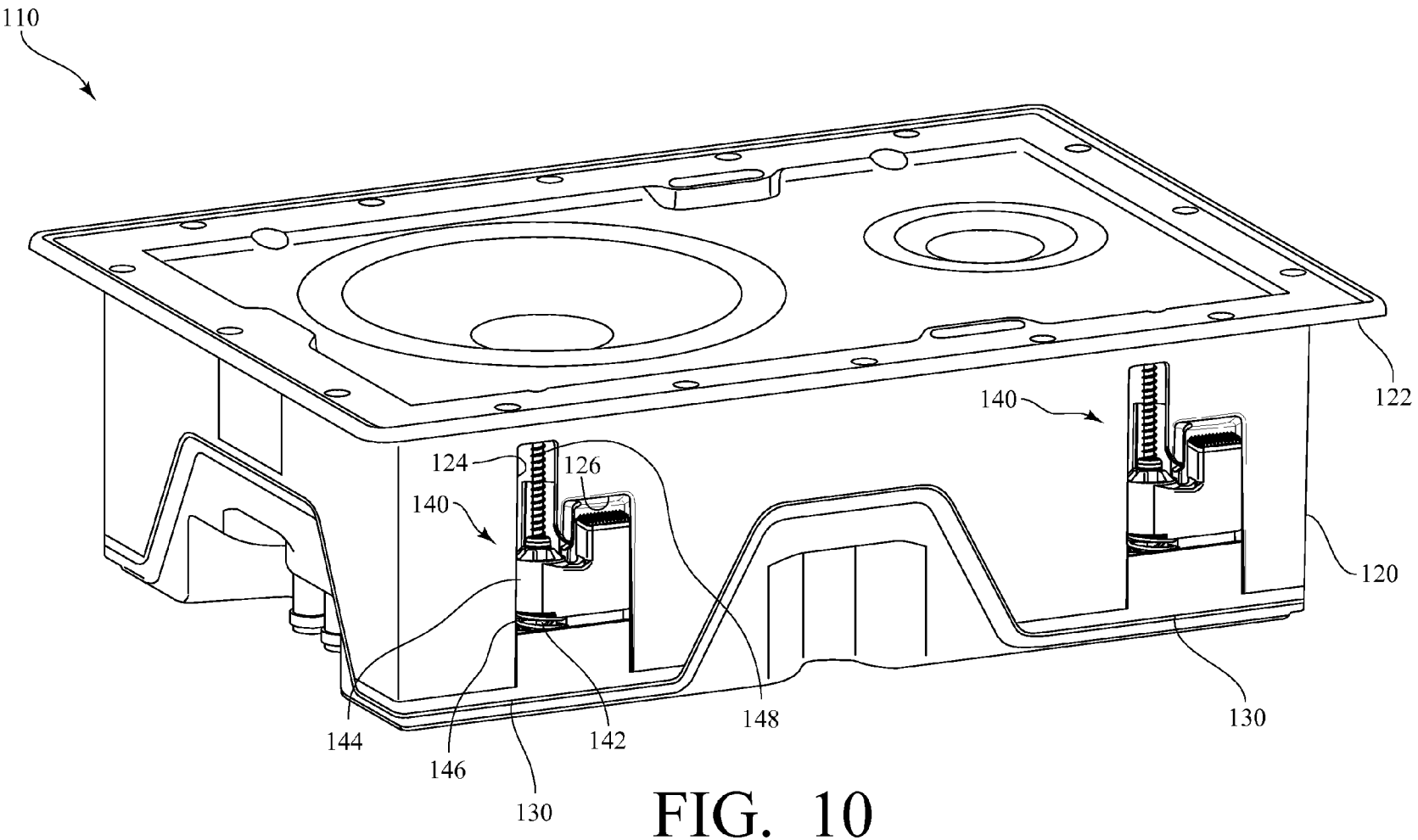
FIG. 10 is a perspective view of another exemplary speaker assembly made in accordance with the present invention.

Referring now to FIG. 10, in another exemplary embodiment of the present invention, the speaker assembly 110 includes a rectangular speaker housing 120 with a front lip 122 and one or more clamping subassemblies 140 housed in the speaker housing 120. Similar to the speaker assembly 10 described above in reference to FIGS. 1-7, the rectangular speaker housing 120 defines a dog tower 124 and clamping dog recess 126 for each of the one or more clamping subassemblies 140, and a dog tower cap 130 attached to the speaker housing 120 at the bottom of the dog tower 124 and adjacent to each of the clamping subassemblies 140. Furthermore, it is contemplated that each of the clamping subassemblies 140 is substantially identical to the clamping subassemblies 40 described above in reference to FIGS. 1-7, and includes a drive dog 142, a clamping dog 144, a compression spring 146, and a dog screw 148. Furthermore, the clamping subassemblies 140 in this exemplary embodiment are capable of transitioning between four different positions or configurations (i.e., a parked position, a ready-to-release position, a released position, and a clamped position) and operate in exactly the same manner as the clamping subassemblies 40 described above. Furthermore, a person of ordinary skill would appreciate that the speaker housing could take various shapes without departing from the spirit and scope of the present invention.

One of ordinary skill in the art will also recognize that additional embodiments and configurations are also possible without departing from the teachings of the present invention or the scope of the claims which follow. This detailed description, and particularly the specific details of the exemplary embodiments disclosed, is given primarily for clarity of understanding, and no unnecessary limitations are to be understood therefrom, for modifications will become obvious to those skilled in the art upon reading this disclosure and may be made without departing from the spirit or scope of the claimed invention.

What is claimed is:

1. A speaker assembly, comprising:

a speaker housing; and one or more clamping subassemblies housed in the speaker housing, each of said clamping subassemblies including a drive dog, a clamping dog with a dogleg, a compression spring extending between the drive dog and the clamping dog, and a dog screw extending through the drive dog and through the clamping dog;

wherein, in a parked position, the drive dog is engaged with the clamping dog with the dogleg of the clamping dog housed in a recess defined by the speaker housing, and the compression spring is in a compressed state;

wherein, through an initial rotation of the dog screw, the clamping subassembly is transitioned from the parked position to a ready-to-release position, in which the dogleg of the clamping dog extends out of the speaker housing, while the compression spring remains in the compressed state;

wherein, through actuating the dog screw, the clamping subassembly is transitioned from the ready-to-release position to a released position, with the drive dog rotating relative to the clamping dog, causing the drive dog to disengage the clamping dog, such that the compression spring is released and moves the clamping dog relative to the speaker housing; and wherein, through further rotation of the dog screw, the clamping subassembly is transitioned from the released position to a clamped position, with the drive dog advancing along the length of the dog screw and returning the compression spring to the compressed state.

2. The speaker assembly of claim 1, wherein the initial rotation of the dog screw is about a one-quarter turn.

3. The speaker assembly of claim 1, wherein the speaker housing defines a channel that extends along the speaker housing adjacent and parallel to the clamping subassembly, and wherein the drive dog includes a tab which extends in a substantially perpendicular orientation from an outer surface of the drive dog, such that, when the clamping subassembly is in the released position, the tab is located in the channel defined by the speaker housing preventing the drive dog from rotating as the drive dog is advancing along the length of the dog screw.

4. The speaker assembly of claim 1, wherein, when the drive dog is engaged with the clamping dog, the drive dog is substantially contained within a cavity defined by the clamping dog.

5. The speaker assembly of claim 1, wherein the dog screw includes threads that frictionally engage the drive dog, but do not engage the clamping dog, such that rotation of the dog screw results in rotation of the drive dog, but not the clamping dog.

6. The speaker assembly of claim 1, and further comprising one or more dog tower caps attached to the speaker housing adjacent to each of the one or more clamping subassemblies, wherein each drive dog includes one or more projections which extend downward from the drive dog and are configured to engage each dog tower cap, such that, upon the initial rotation of the dog screw, the one or more projections of the drive dog engage the dog tower cap causing the dog screw to rise relative to the speaker housing.

7. The speaker assembly of claim 1, further comprising a dog grip positioned on an upper portion of the dogleg and configured to engage a back side of a mounting surface when the clamping subassembly is in the clamped position.

8. The speaker assembly of claim 1, and further comprising a leaf spring having a fixed end, along with a distal end opposite the fixed end, wherein the leaf spring is configured to bias the clamping subassembly into the parked position.

9. The speaker assembly of claim 4, wherein the clamping dog includes one or more supports positioned in the cavity defined by the clamping dog, and wherein the drive dog includes one or more detents that project from an outer surface of the drive dog, such that, when the drive dog is engaged with the clamping dog, each of the one or more detents of the drive dog is engaged with a respective support of the clamping dog.

10. The speaker assembly of claim 4, wherein the clamping dog includes one or more supports positioned in the cavity defined by the clamping dog, and wherein the drive dog defines a helical surface, such that, as the drive dog is advancing along the length of the dog screw, the helical surface of the drive dog engages one of the one or more supports causing the drive dog to rotate in relation to the clamping dog and reengage the clamping dog.

11. The speaker assembly of claim 5, wherein the dog screw is a threaded rolling screw.

12. The speaker assembly of claim 6, wherein the dog screw is actuated by applying a force to the dog screw, such that the one or more projections of the drive dog engage the dog tower cap, thus causing the drive dog to rotate relative to the speaker housing and the clamping dog.

13. The speaker assembly of claim 6, and further comprising a leaf spring having a fixed end connected to the dog tower cap, along with a distal end opposite the fixed end and operably connected to the clamping subassembly, the leaf spring configured to bias the clamping subassembly into the parked position.

14. The speaker assembly of claim 9, wherein the one or more supports of the clamping dog include an upper seat, and wherein the one or more detents of the drive dog include a lower surface with two angled sides that form an apex configured to engage the upper seat of the one or more supports and resist rotation of the drive dog relative to the clamping dog.

15. The speaker assembly of claim 10, wherein a lower inclined surface of the one of the one or more supports of the clamping dog engages the helical surface defined by the drive dog.

16. The speaker assembly of claim 13, wherein the distal end of the leaf spring is operably connected to the clamping subassembly by a bushing positioned within a hole defined by the dog tower cap and including a lip which prevents the bushing from passing completely through the hole defined by the dog tower cap.

17. A clamping assembly for a speaker housing, comprising:

a drive dog;

a clamping dog with a dogleg;

a compression spring extending between the drive dog and the clamping dog; and a dog screw extending through the drive dog and through the clamping dog;

wherein, in a parked position, the drive dog is engaged with the clamping dog with the dogleg of the clamping dog housed in a recess defined by the speaker housing, and the compression spring is in a compressed state;

wherein, through an initial rotation of the dog screw, the clamping subassembly is transitioned from the parked position to a ready-to-release position, in which the dogleg of the clamping dog extends out of the speaker housing, and the dog screw is raised relative to the speaker housing, while the compression spring remains in the compressed state;

wherein, through actuating the dog screw, the clamping subassembly is transitioned from the ready-to-release position to a released position, with the drive dog rotating relative to the clamping dog, causing the drive dog to disengage the clamping dog, such that the compression spring is released; and wherein, through further rotation of the dog screw, the clamping subassembly is transitioned from the released position to a clamped position, with the drive dog advancing along the length of the dog screw and returning the compression spring to the compressed state.

* * * * *